US007351927B1

(12) United States Patent
Rakus et al.

(10) Patent No.: US 7,351,927 B1
(45) Date of Patent: Apr. 1, 2008

(54) ELECTRICAL SWITCH, CONDUCTOR ASSEMBLY, AND INDEPENDENT FLEXIBLE CONDUCTIVE ELEMENTS THEREFOR

(75) Inventors: Paul R. Rakus, Beaver Falls, PA (US); Nathan J. Weister, Darlington, PA (US); Roger J. Briggs, Colgate, WI (US); James R. Schachner, Coraopolis, PA (US); Wilbert E. Lindsay, Bulger, PA (US); Michael C. Watts, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/549,277

(22) Filed: Oct. 13, 2006

(51) Int. Cl.
*H01H 3/00* (2006.01)

(52) U.S. Cl. ..... 200/244; 335/195

(58) Field of Classification Search ..... 200/244, 200/400, 401; 218/22–27; 335/16, 147, 335/195, 166, 6, 202
See application file for complete search history.

(56) References Cited

U.S. PATENT DOCUMENTS 3,523,261 A * 8/1970 Bianchi et al. ..... 335/16
4,129,762 A * 12/1978 Bruchet ..... 200/401
4,887,057 A 12/1989 Gula et al.
4,951,019 A * 8/1990 Gula ..... 335/166
4,996,507 A * 2/1991 McKee et al. ..... 335/195
5,032,813 A * 7/1991 Gula et al. ..... 355/195
5,057,806 A 10/1991 McKee et al.
5,200,724 A 4/1993 Gula et al.
5,866,996 A * 2/1999 Navarre ..... 218/22
5,912,605 A * 6/1999 Eberts ..... 335/16
6,015,959 A * 1/2000 Slepian et al. ..... 200/400
6,188,031 B1 * 2/2001 Turkmen ..... 200/244
6,489,867 B1 * 12/2002 Turner et al. ..... 335/6
6,570,116 B2 5/2003 Maulandi et al.
6,867,671 B2 * 3/2005 Rodriguez et al. ..... 335/132

* cited by examiner

*Primary Examiner*—Michael A Friedhofer
(74) *Attorney, Agent, or Firm*—Martin J. Moran

(57) ABSTRACT

A flexible conductive element is provided for the conductor assembly of an electrical switching apparatus. The conductor assembly includes a load conductor, a movable contact assembly including a number of movable contact arms, movable electrical contacts mounted on the movable contact arms, and a plurality of flexible conductive elements. Each flexible conductive element includes a first end electrically connected to the load conductor, a second end electrically connected to a corresponding one of the movable contact arms of the movable contact assembly, and a plurality of bends between the first end and the second end. A first one of the bends is in a first direction and at least a second one of the bends is in a second direction which is generally opposite the first direction, in order that the flexible element is generally S-shaped. A conductor assembly and an electrical switching apparatus are also disclosed.

22 Claims, 3 Drawing Sheets

ELECTRICAL SWITCH, CONDUCTOR ASSEMBLY, AND INDEPENDENT FLEXIBLE CONDUCTIVE ELEMENTS THEREFOR

CROSS-REFERENCE TO RELATED APPLICATIONS

This application is related to commonly assigned, concurrently filed:

U.S. patent application Ser. No. 11/549,316, filed Oct. 13, 2006, entitled "ELECTRICAL SWITCHING APPARATUS, AND CARRIER ASSEMBLY AND INDEPENDENT PIVOT ASSEMBLY THEREFOR";

U.S. patent application Ser. No. 11/549,309, filed Oct. 13, 2006, entitled "ELECTRICAL SWITCHING APPARATUS, AND MOVABLE CONTACT ASSEMBLY AND CONTACT SPRING ASSEMBLY THEREFOR"; and U.S. patent application Ser. No. 11/549,294, filed Oct. 13, 2006, entitled "ELECTRICAL SWITCHING APPARATUS, AND HOUSING AND INTEGRAL POLE SHAFT BEARING ASSEMBLY THEREFOR", all of which are hereby incorporated herein by reference.

BACKGROUND OF THE INVENTION

1. Field of the Invention

The invention relates generally to electrical switching apparatus and, more particularly, to conductor assemblies for electrical switching apparatus, such as circuit breakers. The invention also relates to flexible conductive elements for circuit breaker conductor assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

Many low-voltage circuit breakers, for example, employ a molded housing having two parts, a first half or front part (e.g., a molded cover), and a second half or rear part (e.g., a molded base). The operating mechanism for such circuit breakers is often mounted to the front part of the housing, and typically includes an operating handle and/or button(s) which, at one end, is (are) accessible from the exterior of the molded housing and, at the other end, is (are) coupled to a pivotable pole shaft. Electrical contact assemblies, which are also disposed within the molded housing, generally comprise a conductor assembly including a movable contact assembly having a plurality of movable contacts, and a stationary contact assembly having a plurality of corresponding stationary contacts. The movable contact assembly is electrically connected to a generally rigid conductor of the conductor assembly by flexible conductors, commonly referred to as shunts. The movable contact assembly includes a plurality of movable contact arms or fingers, each carrying one of the movable contacts and being pivotably coupled to a contact arm carrier. The contact arm carrier is pivoted by a protrusion or arm on the pole shaft of the circuit breaker operating mechanism to move the movable contacts into and out of electrical contact with the corresponding stationary contacts of the stationary contact assembly. The contact arm carrier includes a contact spring assembly structured to bias the fingers of the movable contact assembly against the stationary contacts of the stationary contact assembly in order to provide and maintain contact pressure when the circuit breaker is closed, and to accommodate wear.

The shunts typically comprise either copper wire ropes or layered copper ribbons, and are solidified at their ends using heat and pressure and then brazed to the rigid conductor at one end, and to the fingers of the movable contact assembly at the opposite end. One of the disadvantages associated with known wire rope or braided-type shunts is that they do not fit well within the limited spacing which is available between the adjacent fingers of the movable contact assembly. Specifically, the body of such shunts tends to expand outward and occupy more than the width of the finger, thus interfering with adjacent structures. The wire ropes also tend to bunch together during short circuit events, thus inhibiting the flexibility of the assembly. This is problematic in view of the compound motion which the fingers experience as a result of the well known "heel-toe" and/or "blow-on" arcing schemes which are commonly employed by low-voltage circuit breakers. See, e.g., U.S. Pat. No. 6,005,206, which is hereby incorporated herein by reference. Layered ribbon-type shunts also suffer from a number of unique disadvantages. Among them is the fact that they are typically V-shaped, thus having a single relatively sharp bend which undesirably creates an area of stress concentration. This V shape also consumes a substantial amount of valuable space within the molded housing of the circuit breaker.

There is a need, therefore, for elements (e.g., shunts) which have a high degree of flexibility, yet which are compact in their design and configuration and are rugged in order to accommodate and withstand the full range of movement (e.g., compound motion) of the movable contact assembly of the circuit breaker, while occupying minimal space within the molded housing of the circuit breaker.

There is, therefore, room for improvement of conductor assemblies for electrical switching apparatus such as, for example, low-voltage circuit breakers.

SUMMARY OF THE INVENTION

These needs and others are met by embodiments of the invention, which are directed to a conductor assembly for an electrical switching apparatus, such as, for example, a low-voltage circuit breaker, and independent flexible conductive elements (e.g., shunts) therefor.

As one aspect of the invention, a flexible conductive element is provided for a conductor assembly of an electrical switching apparatus. The electrical switching apparatus includes a stationary contact assembly having a number of stationary electrical contacts and the conductor assembly includes a load conductor and a movable contact assembly with a number of movable contact arms each having a movable electrical contact which is structured to move into and out of electrical contact with a corresponding one of the stationary electrical contacts of the stationary contact assembly. The flexible conductive element comprises: a first end structured to be electrically connected to the load conductor of the conductor assembly; a second end structured to be electrically connected to a corresponding one of the movable contact arms of the movable contact assembly; and a plurality of bends between the first end and the second end, wherein a first one of the bends is in a first direction and at least a second one of the bends is in a second direction, and wherein the second direction of the at least the second one of the bends is generally opposite the first direction of the first one of the bends.

The flexible conductive element may include as the plurality of bends, a first bend in the first direction and a second bend in the second direction, in order that the flexible conductive element is generally S-shaped. The flexible conductive element may further comprise a first portion, a second portion, and a third portion, wherein the first portion is disposed between the first end and the first bend, the second portion is disposed between the first bend and the second bend, and the third portion is disposed between the second bend and the second end of the flexible conductive element. An axis may extend between the first end of the flexible conductive element and the second end of the flexible conductive element, wherein the first portion of the flexible conductive element forms a first angle with respect to the axis and the third portion of the flexible conductive element forms a second angle with respect to the axis. The first angle between the first portion of the flexible conductive element and the axis may be greater than the second angle between the third portion of the flexible conductive element and the axis, for example, when the flexible conductive element is disposed in a first position corresponding to the movable contact of the movable contact assembly being in electrical contact with the corresponding stationary contact of the stationary contact assembly.

As another aspect of the invention, a conductor assembly is provided for an electrical switching apparatus including a stationary contact assembly having a number of stationary electrical contacts. The conductor assembly comprises: a load conductor; a movable contact assembly including a number of movable contact arms; a number of movable electrical contacts mounted on the movable contact arms of the movable contact assembly, the movable electrical contacts being structured to move into and out of electrical contact with the stationary electrical contacts of the stationary contact assembly; and a plurality of flexible conductive elements electrically connecting the load conductor and the movable contact assembly, each of the flexible conductive elements comprising: a first end electrically connected to the load conductor, a second end electrically connected to a corresponding one of the movable contact arms of the movable contact assembly, and a plurality of bends between the first end and the second end, wherein a first one of the bends is in a first direction and at least a second one of the bends is in a second direction, and wherein the second direction of the at least the second one of the bends is generally opposite the first direction of the first one of the bends.

The load conductor may comprise a solid conductor having a first portion and a second portion generally opposite the first portion, wherein the solid conductor includes a first aperture at or about the first portion of the solid conductor. The first aperture may comprise a single elongated recess which receives the first end of every one of the flexible conductors. The first aperture of the load conductor may further comprise an interior arcuate portion and a neck portion. The corresponding one of the movable contact arms may comprise a second aperture having an interior arcuate portion and a neck portion. The first end of the flexible conductive element may comprise a first generally round head disposed within the interior arcuate portion of the first aperture of the load conductor, and the second end of the flexible conductive element may comprise a second generally round head disposed within the interior arcuate portion of the second aperture of the corresponding one of the movable contact arms. When the first generally round head is disposed within the interior arcuate portion of the first aperture of the load conductor and the second generally round head is disposed within the interior arcuate portion of the second aperture of the corresponding one of the movable contact arms, the neck portion of at least one of the first aperture and the second aperture may be compressed against the flexible conductive element in order to retain a corresponding one of the first end of the flexible conductive element within the first aperture and the second end of the flexible conductive element within the second aperture. At least one of the first and second generally round heads may further comprise a pin, and the flexible conductive member may comprise a shunt having layers of conductive ribbon, wherein the layers of conductive ribbon wrap around the pin within at least one of the first and second apertures of the load conductor and the corresponding one of the movable contact arms, respectively.

As yet another aspect of the invention, a conductor assembly is provided for an electrical switching apparatus. The conductor assembly comprises: a load conductor; a movable contact assembly including a number of movable contact arms; a plurality of flexible conductive elements, each of the flexible conductive elements including a first end electrically connected to the load conductor and a second end electrically connected to a corresponding one of the movable contact arms of the movable contact assembly; and at least one pin, wherein the load conductor is a single solid load conductor including a single elongated recess, wherein the single elongated recess receives the first end of every one of the flexible conductive elements, and wherein at least one pin is inserted through the first end of every one of the flexible conductive elements within the single elongated recess of the single solid load conductor.

As another aspect of the invention, an electrical switching apparatus comprises: a housing; a first electrical conductor and a second electrical conductor housed by the housing; a stationary contact assembly including a number of stationary electrical contacts, the stationary contact assembly being electrically connected to one of the first electrical conductor and the second electrical conductor; and a conductor assembly electrically connected to the other of the first electrical conductor and the second electrical conductor, the conductor assembly comprising: a load conductor, a movable contact assembly including a number of movable contact arms; a number of movable electrical contacts mounted on the movable contact arms of the movable contact assembly, the movable electrical contacts being operable between a closed position in which the movable electrical contacts are in electrical contact with the stationary electrical contacts of the stationary contact assembly, and an open position in which the movable electrical contacts are out of electrical contact with the stationary electrical contacts, and a plurality of flexible conductive elements electrically connecting the load conductor and the movable contact assembly, each of the flexible conductive elements comprising: a first end electrically connected to the load conductor, a second end electrically connected to a corresponding one of the movable contact arms of the movable contact assembly, and a plurality of bends between the first end and the second end, wherein a first one of the bends is in a first direction and at least a second one of the bends is in a second direction, and wherein the second direction of the second one of the bends is generally opposite the first direction of the first one of the bends.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
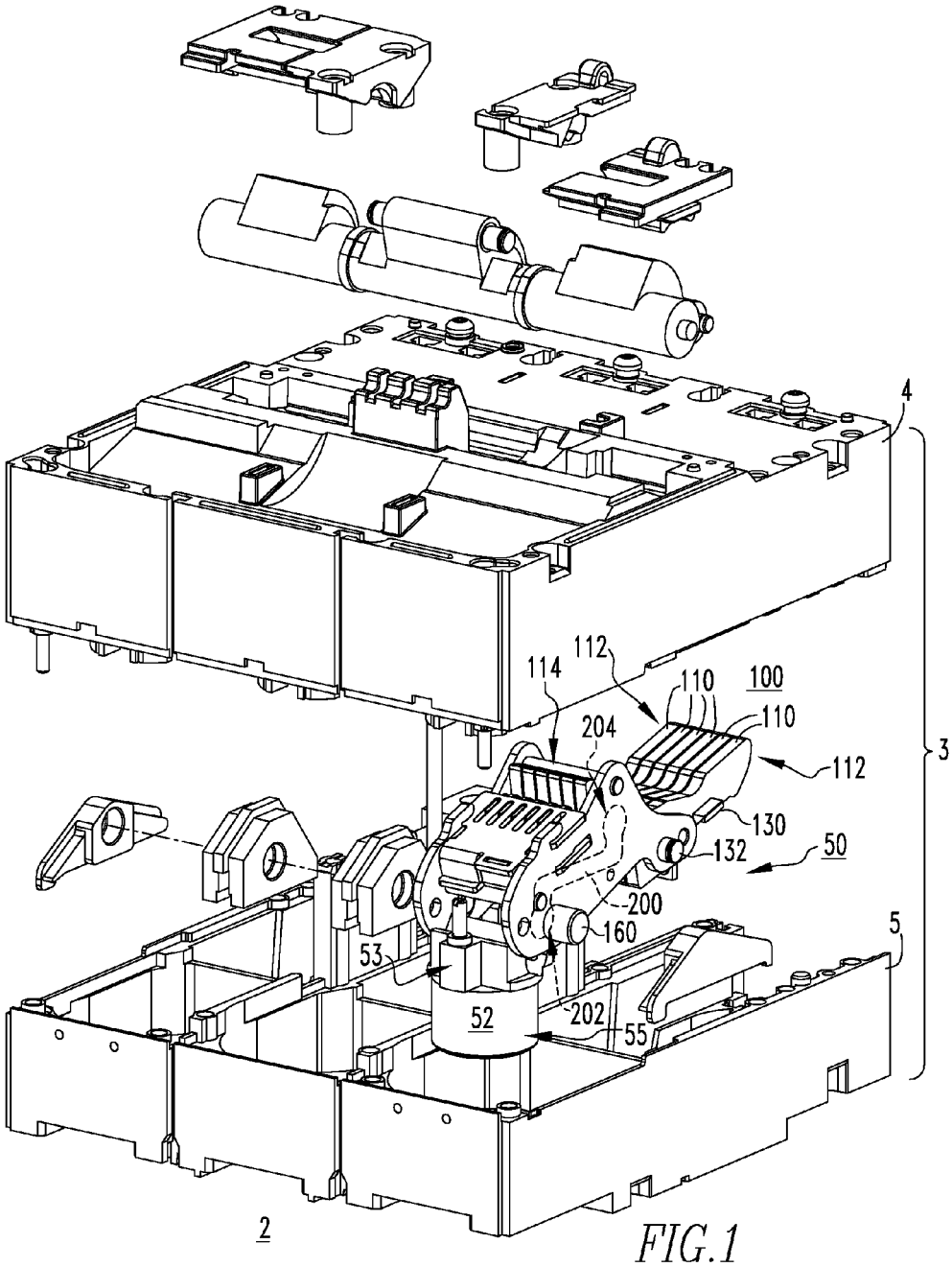
FIG. 1 is an exploded isometric view of a low-voltage circuit breaker and one of the conductor assemblies therefor, in accordance with an embodiment of the invention.

For purposes of illustration, embodiments of the invention will be described as applied to low-voltage circuit breakers, although it will become apparent that they could also be applied to the contact assemblies of any known or suitable electrical switching apparatus (e.g., without limitation, circuit switching devices and circuit interrupters such as circuit breakers other than low-voltage circuit breakers, network protectors, contactors, motor starters, motor controllers and other load controllers).

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a low-voltage circuit breaker 2 including a housing 3 which encloses a conductor assembly 50 having a movable contact assembly 100 with flexible conductive elements 200 (one flexible element 200 is shown in hidden line drawing in simplified form in FIG. 1), in accordance with embodiments of the invention. The housing 3 includes a first half or front part 4 (e.g., a molded cover) and a second half or back part 5 (e.g., a molded base), with the conductor assembly 50 being disposed therebetween. The low-voltage circuit breaker 2 further includes first and second conductors such as the example line and load conductors 6,8 partially shown in phantom line drawing in simplified form in FIG. 3.

Figure 2:
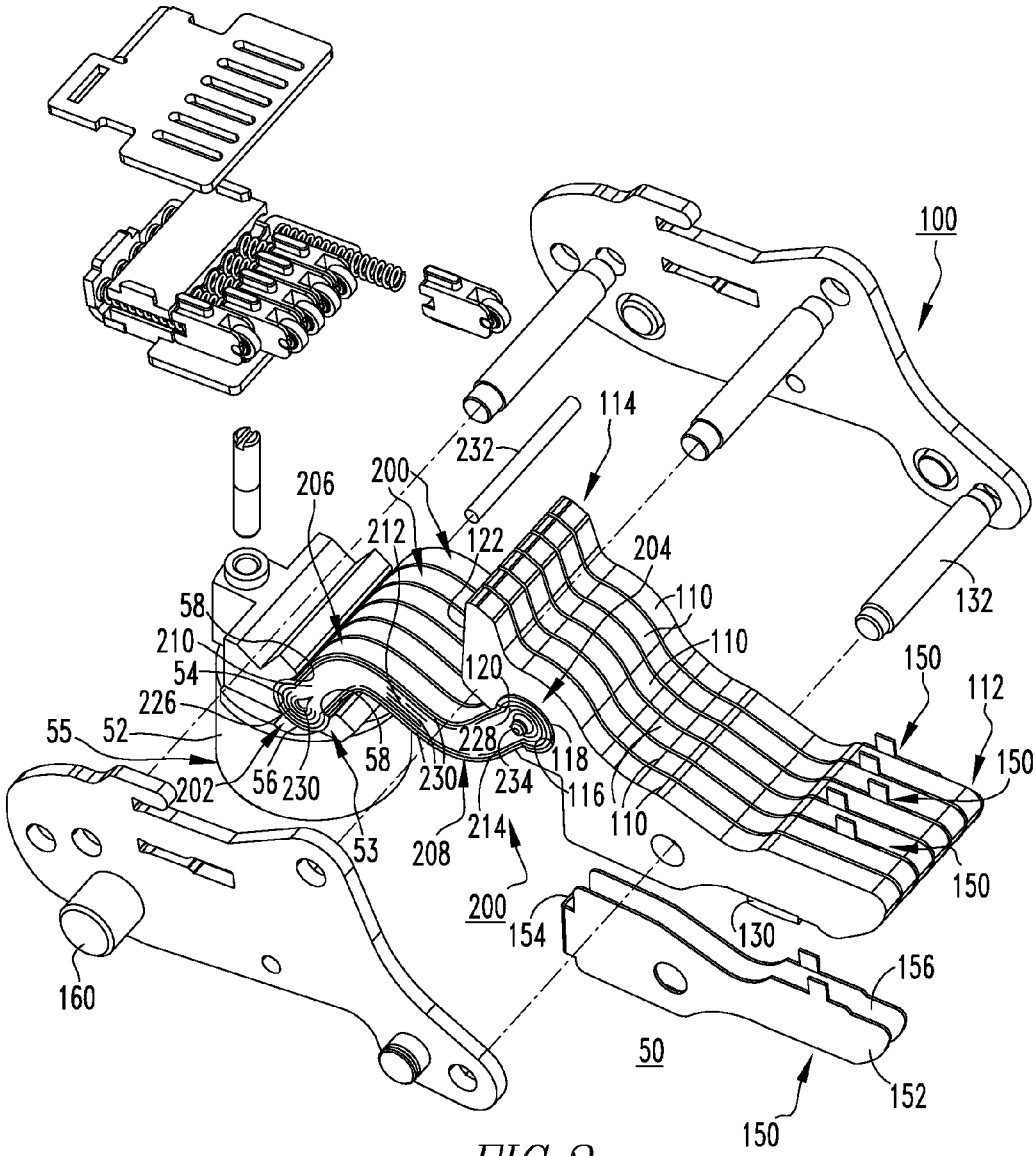
FIG. 2 is an exploded isometric view of the conductor assembly of FIG. 1.
Figure 3:
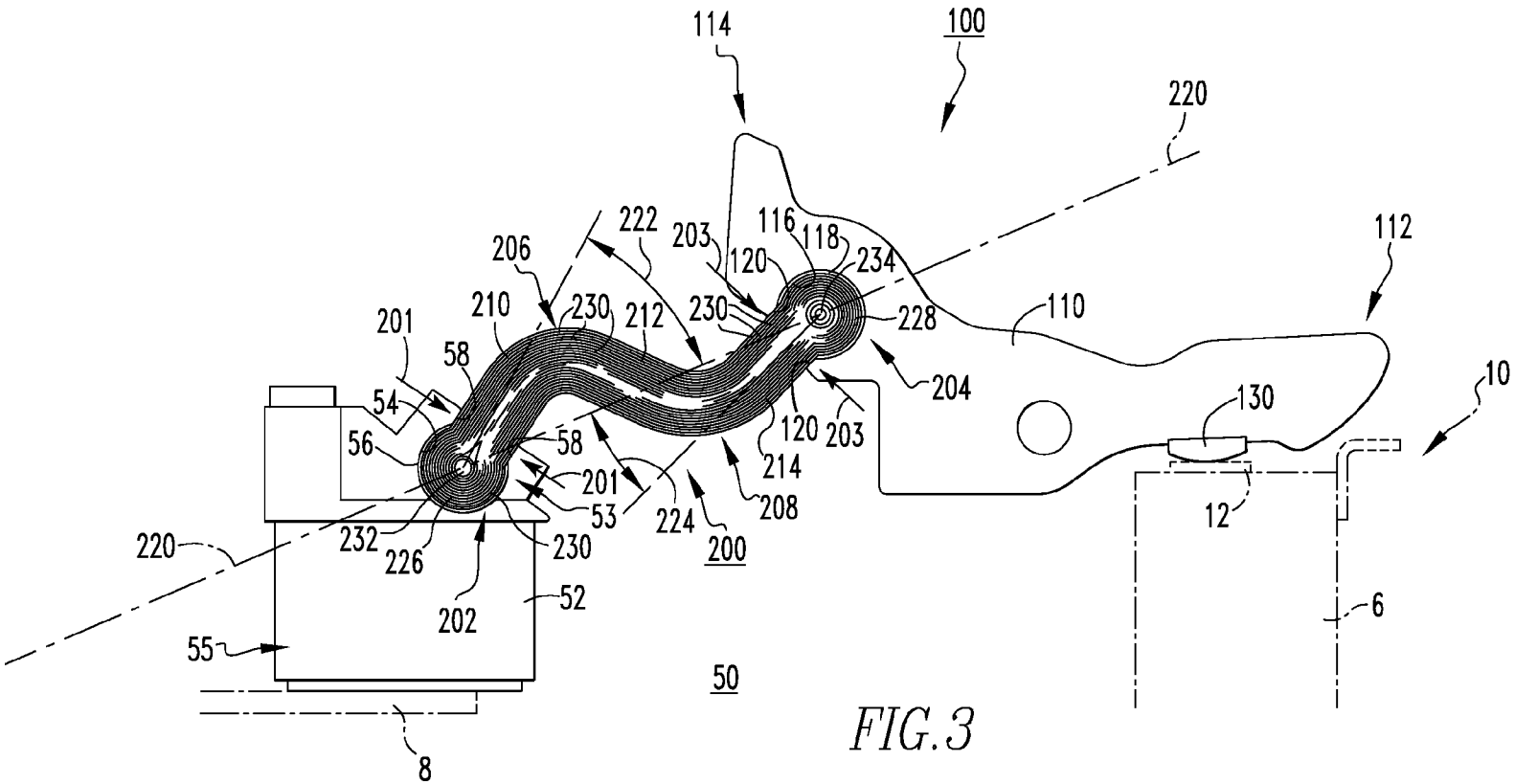
FIG. 3 is a side elevational view of a portion of the conductor assembly of FIG. 1 and a flexible shunt therefor, in accordance with an embodiment of the invention.

As shown in FIGS. 2 and 3, the conductor assembly 50 includes a load conductor 52, a movable contact assembly 100, and a plurality of the flexible conductive elements 200 electrically connecting the load conductor 52 and the movable contact assembly 100. The movable contact assembly 100 includes a plurality of movable contact arms 110. Each of the movable contact arms 110 has a first end 112 and a second end 114. A movable electrical contact 130 is coupled to each movable contact arm 110 at or about the first end 112 thereof, and is structured to move into and out of electrical contact with a corresponding stationary electrical contact 12 (FIG. 3) of the low-voltage circuit breaker 2 (FIG. 1). Specifically, as shown in FIG. 3, the first electrical conductor or line conductor 6 of the circuit breaker 2 (FIG. 1) includes a stationary contact assembly 10 (shown in phantom line drawing in simplified form) having a plurality of stationary electrical contacts 12 (one stationary electrical contact 12 is shown in FIG. 3).

When the conductor assembly 50 is assembled within the circuit breaker housing 3 (FIG. 1) the load conductor 52 is in electrical contact with the second electrical conductor or load conductor 8 of the circuit breaker 2 and the movable electrical contact 130 is movable into (FIG. 3) and out of (not shown) electrical contact with the corresponding stationary electrical contact 12 of the stationary contact assembly 10. It will be appreciated that, for simplicity of illustration, only one conductor assembly 50 is shown in the figures. Typically, however, the low-voltage circuit breaker 2, shown in FIG. 1, which is a three-pole circuit breaker 2, would include three such conductor assemblies 50, one for each of the poles of the circuit breaker 2. It will further be appreciated that the conductor assembly 50 could be employed with any known or suitable electrical switching apparatus having any number of poles other than the three-pole low-voltage circuit breaker 2 shown and described in connection with FIG. 1.

Referring to FIGS. 2 and 3, each of the flexible conductive elements 200 which electrically connect the load conductor 52 of the conductor assembly 50 to the movable contact assembly 100, includes a first end 202 structured to be electrically connected to the load conductor 52, a second end 204 structured to be electrically connected to a corresponding one of the movable contact arms 110 of the movable contact assembly 100, and a plurality of bends 206,208 between the first end 202 and the second end 204. As best shown in FIG. 3, a first one of the bends 206 is in a first direction and at least a second one of the bends 208 is in a second direction which is generally opposite the first direction of the first bend 206. More specifically, the example flexible conductive element 200 is a shunt comprising layered conductive ribbon 230 (shown exaggerated in FIGS. 2 and 3 for ease of illustration), and includes two bends 206,208, a first bend 206 in the first direction, and a second bend 208 in the second direction in order that the shunt 200 is generally S-shaped. Accordingly, the shunt 200 includes a first portion 210 disposed between the first end 202 and the first bend 206, a second portion 212 disposed between first bend 206 and second bend 208, and a third portion 214 disposed between second bend 208 and the second end 204 of the shunt 200. The generally S-shape configuration of the shunt 200 permits it to have a relatively low profile in a vertical direction, thus minimizing the amount of space required for the conductor assembly 50 within the circuit breaker housing 2 (FIG. 1).

An axis 220 extends between the first end 202 of the shunt 200 and the second end 204 of the shunt 200. The first portion 210 of the shunt 200 forms a first angle 222 with respect to axis 220 on one side of the axis, and the third portion 214 of the shunt 200 forms a second angle 224 with respect to the axis 220, on the opposite side of the axis 220. Preferably the first and second angles 222,224 of the first and third portions 210,214 of shunt 200, are different. For example, the first angle 222 of the shunt 200 of FIG. 3 is greater than second angle 224. By way of a non-limiting example, the first angle 222 of the example shunt 200 is between about 26 degrees and about 36 degrees with respect to axis 220, and the second angle 224 is between about 11 degrees and about 22 degrees. It will, however, be appreciated that any known or suitable shunt configuration could be employed in accordance with embodiments of the invention to accommodate the compound motion of the conductor assembly 50 while minimizing areas of stress concentration in the shunts 200 and providing a compact shunt design. It will also be appreciated that while the shunt 200 is contemplated as being made from wound layered conductive ribbon 230 which is made of copper, that any known or suitable electrically conductive material could alternatively be employed without departing from the scope of the invention. Likewise, while the example shunt 200 has about 58 layers of conductive ribbon 230, a width of about 0.35 inches, a length of about 2.2 inches (measured from the center of the first end 202 of shunt 200 to the center of the second end 204 thereof), an overall thickness of about 0.187 inches, and a ribbon layer thickness of about 0.003 inches, it will be appreciated that one or more of these dimensions could be changed to any known or suitable value as necessary for the particular application in which the shunt 200 will be used.

Continuing to refer to FIGS. 2 and 3, the load conductor 52 of the conductor assembly 50 comprises a solid conductor 52 having a first portion 53 and a second portion 55 generally opposite the first portion 53. The first portion 53 includes a first aperture which generally comprises a single elongated recess 54 (best shown in FIG. 2). The single elongated recess 54 receives the first ends 202 of all of the shunts 200. The second ends 204 of the shunts 200 are received in corresponding second apertures 116 in the second ends 114 of each of the movable contact arms 110 (six shunts 200 are shown in FIG. 2). More specifically, the first end 202 of each shunt 200 comprises a first generally round head 226 and the second end 204 of the shunt 200 comprises a second generally round head 228. The single elongated recess 54 of the load conductor 52 and the second aperture 116 of the corresponding movable contact arms 110 each comprise an interior arcuate portion 56,118 and a neck portion 58,120, respectively, as shown. The first generally round head 226 of the first end 202 of shunt 200 is disposed within the interior arcuate portion 56 of the first aperture or single elongated recess 54 of the load conductor 52, as shown, and the neck portion 58 of the first aperture 54 is compressed against shunt 200 in the direction indicated by arrows 201 of FIG. 3 in order to retain the first end 202 of the shunt 200 within the first aperture 54. Similarly, the second generally round head 228 is disposed within the second aperture 116 of the corresponding movable contact arm 110, and the second end 204 of the shunt 200 is retained within the interior arcuate portion 118 of the second aperture 116. Such retention can be provided by the neck portion 120 of the second aperture 116 being compressed against the shunt 200 in the direction generally indicated by arrows 203 of FIG. 3, but may further or alternatively be provided by a pin 234 being inserted through the round head 228 (discussed hereinbelow) and then swaged or peened to expand the layers of conductive ribbon 230 of the second end 204 radially outward against the interior arcuate portion 118 of the second aperture 116.

For each of the example shunts 200, the first and second generally rounds heads 226,228 of the first and second ends 202,204 further include first and second pins 232,234 disposed through the center of the heads 226,228 within the first and second apertures 54,116, respectively. More specifically, the layers of conductive ribbon 230 of the shunt 200 wrap around the first and second pins 232,234 within the first and second apertures 54,116, respectively, of the load conductor 52 and the corresponding movable contact arm 110, respectively, as shown in FIG. 3.

In FIG. 2, the first pin 232 is shown before being inserted through the center of the first generally round head 226 of each of the shunts 200 within the interior arcuate portion 56 of the single elongated recess 54 of the load conductor 52. Accordingly, it will be appreciated that the first and second ends 202,204 of the shunts are secured within the first and second apertures 54,116, respectively, of the load conductor 52 and the corresponding movable contact arms 210. This may be accomplished by, for example and without limitation, swaging or crimping a portion (e.g., neck portion 58) of the load conductor 52 adjacent the first aperture 54, and a portion (e.g., neck portion 120) of the corresponding movable contact arm 110 adjacent the second aperture 116 against the first and second ends 202,204 of the shunts 200, respectively, or by any other known or suitable fastening process or mechanism, such as, for example, a rivet 232,234 (e.g., a staked or suitably deformed pin), solder, brazing, or any suitable combination thereof.

As best shown in FIG. 2, the movable contact assembly 100 may further include a plurality of spacers 150 structured to separate the movable contact arms 110 of the assembly 100 from one another. Specifically, each of the spacers 150 includes a first portion 152, a connection portion 154, and a second portion 156 spaced opposite from the first portion 152, as shown. Each of the movable contact arms 110 of the movable contact assembly 100 is disposed between the first and second portions 152,156 of one of the spacers 150, thereby separating one movable contact arm 110 from at least one other movable contact arm 110 of the movable contact assembly 100. The spacers 150 may be made from any known or suitable material, such as, for example and without limitation, vulcanized fiber material, commonly referred to as fish paper. It will be appreciated that the spacers 150 may, but need not necessarily, also serve to electrically and/or thermally insulate the movable contact arms 110 of the assembly 100 from one another.

Accordingly, the conductor assembly 50 includes generally S-shaped flexible conductive elements 200 (e.g., shunts) which enable it to accommodate the compound motion (e.g., movement in more than one direction at the same time, such as, for example and without limitation, pivoting of the conductor assembly 50 about first pivot pin 160 and/or pivot pin 132 of FIGS. 1 and 2, and bending of one or more portions 210,212,214 of the shunt 200 when the movable contact arms 110 pivot in response to a trip condition) of the conductor assembly 50 through all stages of circuit breaker operation, while providing a compact design which advantageously occupies a minimal amount of the valuable space within the circuit breaker housing 3 (FIG. 1). Thus, flexible conductive elements 200 which are robust, compact in size, shape and configuration, and are economical to manufacture are provided by embodiments of the invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A flexible conductive element for a conductor assembly of an electrical switching apparatus including a stationary contact assembly having a number of stationary electrical contacts, said conductor assembly including a load conductor and a movable contact assembly with a number of movable contact arms each having a movable electrical contact structured to move into and out of electrical contact with a corresponding one of said stationary electrical contacts of said stationary contact assembly, said flexible conductive element comprising:

a first end structured to be electrically connected to said load conductor of said conductor assembly;

a second end structured to be electrically connected to a corresponding one of said movable contact arms of said movable contact assembly; and a plurality of bends between the first end and the second end, wherein a first one of said bends is in a first direction and at least a second one of said bends is in a second direction, wherein the second direction of said at least a second one of said bends is generally opposite the first direction of said first one of said bends, wherein said flexible conductive element has a predetermined shape, and wherein said flexible conductive element is structured to substantially maintain said predetermined shape, without employing a separate structure between the first end of said flexible conductive element and the second end of said flexible conductive element to hold said flexible conductive element in position.

2. The flexible conductive element of claim 1 wherein said flexible conductive element includes as said plurality of bends, a first bend in the first direction and a second bend in the second direction, in order that said predetermined shape of said flexible conductive element is generally S-shaped.

3. The flexible conductive element of claim 2 wherein said flexible conductive element further comprises a first portion, a second portion, and a third portion; wherein said first portion is disposed between the first end and said first bend; wherein said second portion is disposed between said first bend and said second bend; wherein said third portion is disposed between said second bend and the second end of said flexible conductive element; wherein an axis extends between the first end of said flexible conductive element and the second end of said flexible conductive element; wherein said first portion of said flexible conductive element forms a first angle with respect to said axis; and wherein said third portion of said flexible conductive element forms a second angle with respect to said axis.

4. The flexible conductive element of claim 3 wherein said flexible conductive element is operable among a first position corresponding to said movable electrical contact of said movable contact assembly being in electrical contact with said corresponding one said stationary electrical contacts of said stationary contact assembly, and a second position corresponding to said movable electrical contact being separated from said corresponding one of said stationary contacts; wherein when said flexible conductive element is disposed in said first position, said first angle between said first portion of said flexible conductive element and said axis is greater than said second angle between said third portion of said flexible conductive element and said axis.

5. The flexible conductive element of claim 1 wherein said flexible conductive element is a layered conductive ribbon shunt.

6. A conductor assembly for an electrical switching apparatus including a stationary contact assembly having a number of stationary electrical contacts, said conductor assembly comprising:

a load conductor;

a movable contact assembly including a number of movable contact arms;

a number of movable electrical contacts mounted on said movable contact arms of said movable contact assembly, said movable electrical contacts being structured to move into and out of electrical contact with said stationary electrical contacts of said stationary contact assembly; and a plurality of flexible conductive elements electrically connecting said load conductor and said movable contact assembly, each flexible conductive element of said plurality of flexible conductive elements comprising:

a first end electrically connected to said load conductor, a second end electrically connected to a corresponding one of said movable contact arms of said movable contact assembly, and a plurality of bends between the first end and the second end, wherein a first one of said bends is in a first direction and at least a second one of said bends is in a second direction, wherein the second direction of said at least a second one of said bends is generally opposite the first direction of said first one of said bends, wherein said each flexible conductive element has a predetermined shape, and wherein said each flexible conductive element is structured to substantially maintain said predetermined shape, without employing a separate structure between the first end of said flexible conductive element and the second end of said flexible conductive element to hold said flexible conductive element in position.

7. The conductor assembly of claim 6 wherein said load conductor includes a first aperture; wherein the first end of said flexible conductive element is disposed in said first aperture of said load conductor; wherein said corresponding one of said movable contact arms includes a first end and a second end; wherein the second end of said corresponding one of said movable contact arms includes a second aperture; and wherein the second end of said flexible conductive element is disposed with said second aperture of said corresponding one of said movable contact arms.

8. The conductor assembly of claim 7 wherein said load conductor comprises a solid conductor having a first portion and a second portion generally opposite said first portion; wherein said first aperture comprises a single elongated recess disposed at or about said first portion of said solid conductor; and wherein said single elongated recess receives the first end of every one of said flexible conductive elements.

9. The conductor assembly of claim 7 wherein said first aperture of said load conductor comprises an interior arcuate portion and a neck portion; wherein said second aperture of said corresponding one of said movable contact arms comprises an interior arcuate portion and a neck portion; wherein the first end of said flexible conductive element comprises a first generally round head, and the second end of said flexible conductive element comprises a second generally round head; wherein said first generally round head of the first end of said flexible conductive element is disposed within said interior arcuate portion of said first aperture of said load conductor, and said second generally round head of the second end of said flexible conductive element is disposed within said interior arcuate portion of said second aperture of said corresponding one of said movable contact arms; and wherein, when said first generally round head is disposed within said interior arcuate portion of said first aperture of said load conductor and said second generally round head is disposed within said interior arcuate portion of said second aperture of said corresponding one of said movable contact arms, said neck portion of at least one of said first aperture and said second aperture is compressed against said flexible conductive element in order to retain a corresponding one of the first end of said flexible conductive element within said first aperture and the second end of said flexible conductive element within said second aperture.

10. The conductor assembly of claim 9 wherein said flexible conductive element comprises a shunt having a plurality of layers of conductive ribbon; wherein at least one of said first generally round head of the first end of said shunt and said second generally round head of the second end of said shunt further comprises a pin; and wherein said layers of conductive ribbon of said shunt wrap around said pin within at least one of said first and second apertures of said load conductor and said corresponding one of said movable contact arms, respectively.

11. The conductor assembly of claim 7 wherein the first end of said flexible conductive element and the second end of said flexible conductive element are secured within said first aperture of said load conductor and said second aperture of said corresponding one of said movable contact arms, respectively, by at least one of a rivet, solder, a portion of said load conductor adjacent said first aperture being crimped against the first end of said flexible conductive element, a portion of said corresponding one of said movable contact arms adjacent said second aperture being crimped against the second end of said flexible conductive element, a portion of said load conductor adjacent said first aperture being swaged against the first end of said flexible conductive element, and a portion of said corresponding one of said movable contact arms adjacent said second aperture being swaged against the second end of said flexible conductive element.

12. The conductor assembly of claim 6 wherein said movable contact assembly further includes a plurality of spacers disposed between adjacent pairs of said movable contact arms.

13. The conductor assembly of claim 6 wherein said flexible conductive element further comprises a first portion, a second portion, and a third portion; wherein said first portion is disposed between the first end and said first bend; wherein said second portion is disposed between said first bend and said second bend; wherein said third portion is disposed between said second bend and the second end of said flexible conductive element; wherein an axis extends between the first end of said flexible conductive element and the second end of said flexible conductive element; wherein said first portion of said flexible conductive element forms a first angle with respect to said axis; and wherein said third portion of said flexible conductive element forms a second angle with respect to said axis.

14. A conductor assembly for an electrical switching apparatus, said conductor assembly comprising:

a load conductor;

a movable contact assembly including a number of movable contact arms;

a plurality of flexible conductive elements, each of said flexible conductive elements including a first end electrically connected to said load conductor, a second end electrically connected to a corresponding one of said movable contact arms of said movable contact assembly; and at least one pin, wherein said load conductor is a single solid load conductor including a single elongated recess, wherein said single elongated recess receives the first end of every one of said flexible conductive elements, and wherein at least one of said at least one pin is inserted through the first end of every one of said flexible conductive elements within said single elongated recess of said single solid load conductor.

15. An electrical switching apparatus comprising:

a housing;

a first electrical conductor and a second electrical conductor housed by said housing;

a stationary contact assembly including a number of stationary electrical contacts, said stationary contact assembly being electrically connected to one of said first electrical conductor and said second electrical conductor; and a conductor assembly electrically connected to the other of said first electrical conductor and said second electrical conductor, said conductor assembly comprising:

a load conductor, a movable contact assembly including a number of movable contact arms;

a number of movable electrical contacts mounted on said movable contact arms of said movable contact assembly, said movable electrical contacts being operable between a closed position in which said movable electrical contacts are in electrical contact with said stationary electrical contacts of said stationary contact assembly, and an open position in which said movable electrical contacts are out of electrical contact with said stationary electrical contacts, and a number of flexible conductive elements electrically connecting said load conductor and said movable contact assembly, each flexible conductive element of said number of flexible conductive elements comprising:

a first end electrically connected to said load conductor, a second end electrically connected to a corresponding one of said movable contact arms of said movable contact assembly, and a plurality of bends between the first end and the second end, wherein a first one of said bends is in a first direction and at least a second one of said bends is in a second direction, wherein the second direction of said at least a second one of said bends is generally opposite the first direction of said first one of said bends, wherein said each flexible conductive element has a predetermined shape, and wherein said each flexible conductive element is structured to substantially maintain said predetermined shape, without employing a separate structure between the first end of said flexible conductive element and the second end of said flexible conductive element to hold said flexible conductive element in position.

16. The electrical switching apparatus of claim 15 wherein said load conductor includes a first aperture receiving the first end of said flexible conductive element; wherein said corresponding one of said movable contact arms includes a first end and a second end; and wherein the second end of said corresponding one of said movable contact arms includes a second aperture receiving the second end of said flexible conductive element.

17. The electrical switching apparatus of claim 16 wherein said load conductor comprises a solid conductor having a first portion and a second portion generally opposite said first portion; wherein said first aperture comprises a single elongated recess disposed at or about said first portion of said solid conductor; and wherein said single elongated recess receives the first end of every one of said flexible conductive elements.

18. The electrical switching apparatus of claim 16 wherein said first aperture of said load conductor comprises an interior arcuate portion and a neck portion; wherein said second aperture of said corresponding one of said movable contact arms comprises an interior arcuate portion and a neck portion; wherein the first end of said flexible conductive element comprises a first generally round head, and the second end of said flexible conductive element comprises a second generally round head; wherein said first generally round head of the first end of said flexible conductive element is disposed within said interior arcuate portion of said first aperture of said load conductor, and said second generally round head of the second end of said flexible conductive element is disposed within said interior arcuate portion of said second aperture of said corresponding one of said movable contact arms; and wherein, when said first generally round head is disposed within said interior arcuate portion of said first aperture of said load conductor and said second generally round head is disposed within said interior arcuate portion of said second aperture of said corresponding one of said movable contact arms, said neck portion of at least one of said first aperture and said second aperture is compressed against said flexible conductive element in order to retain a corresponding one of the first end of said flexible conductive element within said first aperture and the second end of said flexible conductive element within said second aperture.

19. The electrical switching apparatus of claim 18 wherein said flexible conductive element comprises a shunt having a plurality of layers of conductive ribbon; wherein said first generally round head of the first end of said shunt and said second generally round head of the second end of said shunt further comprise first and second pins; and wherein said layers of conductive ribbon of said shunt wrap around said first and second pins within said first and second apertures of said load conductor and said corresponding one of said movable contact arms, respectively.

20. The electrical switching apparatus of claim 15 wherein said movable contact assembly further comprises a plurality of spacers; wherein each of said spacers includes a first portion, a connection portion, and a second portion spaced opposite from said first portion; and wherein said corresponding one of said movable contact arms of said movable contact assembly is disposed between said first portion and said second portion in order to separate said corresponding one of said movable contact arms from at least one other of said movable contact arms.

21. The electrical switching apparatus of claim 15 wherein said flexible conductive element includes as said plurality of bends, a first bend in the first direction and a second bend in the second direction, in order that said predetermined shape of said flexible conductive element is generally S-shaped; wherein said flexible conductive element further comprises a first portion disposed between the first end and said first bend, a second portion disposed between said first bend and said second bend, and a third portion disposed between said second bend and the second end of said flexible conductive element; wherein said first portion of said flexible conductive element forms a first angle with respect to an axis extending between the first end of said flexible conductive element and the second end of said flexible conductive element; and wherein said third portion of said flexible conductive element forms a second angle with respect to said axis.

22. The flexible conductive element of claim 3 wherein said first angle is between about 26 degrees and about 36 degrees; and wherein said second angle is between about 11 degrees and about 22 degrees.

* * * * *